US005954242A

United States Patent [19]

Deschenes et al.

[11] Patent Number: 5,954,242

[45] Date of Patent: Sep. 21, 1999

[54] BUTTON ATTACHING DEVICE

[75] Inventors: Charles L. Deschenes, North Attleboro; Paul A. Davignon, Uxbridge; William Hartman, Quincy; Hugh Smith, West Roxbury; Douglas Cooke, Charlestown, all of Mass.

[73] Assignee: Avery Dennison Corporation, Pasadena, Calif.

[21] Appl. No.: 08/754,586

[22] Filed: Nov. 19, 1996

[51] Int. Cl.[6] ..... A41H 43/00; D05B 3/14

[52] U.S. Cl. ..... 223/1; 2/265; 112/475.15; 112/110; 112/108

[58] Field of Search ..... 2/265; 223/1; 112/108, 112/110, 169, 475.15

[56] References Cited

U.S. PATENT DOCUMENTS

| | | | |
|---|---|---|---|
| 1,674,544 | 6/1928 | Hertelendy | 112/475.15 |
| 2,935,434 | 5/1960 | Dawson | 2/265 |
| 3,900,925 | 8/1975 | La Torraca | 24/90 |
| 4,281,782 | 8/1981 | Marsh et al. | 112/110 |
| 4,296,698 | 10/1981 | Davidson | 112/110 |
| 4,316,562 | 2/1982 | Davidson et al. | 112/110 |
| 4,361,101 | 11/1982 | Marsh et al. | 112/110 |
| 5,518,162 | 5/1996 | Deschenes et al. | 227/71 |
| 5,588,575 | 12/1996 | Davignon | 227/67 |

FOREIGN PATENT DOCUMENTS

| | | | |
|---|---|---|---|
| 3514705 | 10/1985 | Germany | 2/265 |

OTHER PUBLICATIONS

"Hang on to your needle and thread" CU Article p. 474.

*Primary Examiner*—Bibhu Mohanty
*Attorney, Agent, or Firm*—Kriegsman & Kriegsman

[57] ABSTRACT

A button attaching device for attaching a button having four holes to a layer of material includes a holder having a front end and a rear end, four rodless fastener dispensing needles projecting out from the front end of the holder and two fasteners, each having a foot at each end of an elongated filament. Each foot is removably mounted on one of the rodless fastener dispensing needles. A cover is removably mounted on the front end of the holder and includes an anvil. In use, the cover is removed from the holder and the layer of material placed on the cover over the anvil. The button is then placed over the layer of material. The holder is then pushed in the direction of the cover so that the needles and fastener feet extend through the holes in the button and through the layer of material, with the tips of the needles striking the anvil. The tension on the filaments of the fasteners causes the feet to pop out from the needles. The needles are then withdrawn leaving the button secured to the layer of material by the fasteners.

6 Claims, 5 Drawing Sheets

BUTTON ATTACHING DEVICE

BACKGROUND OF THE INVENTION

The present invention relates to a button attaching device and, more particularly to a hand operated button attaching device.

In U.S. Pat. No. 3,900,925 to G. A. LaTorrace there is disclosed a one piece, durable button attaching device comprising a hollow pointed needle portion having a longitudinal slot along a portion of the top thereof. The rear end of the needle is immovably mounted in a rounded handle portion or other gripping means. Angular shaped fasteners having a vertical shank with a pair of oppositely slanting legs extend an equal distance from the top and bottom thereof forming approximately a 55 degree angle on one side of the shank and a 125 degree angle relative thereto on the other side.

In U.S. Pat. No. 4,281,782 to W. H. W. Marsh et al. there is disclosed a button sewing device which includes a base, a pair of needles which carry collapsible thread formed loops, and project from the base for use in penetrating a layer of material and the holes of a button to be attached to the material; and with elastomeric material over the base compressible by pressure on the material to which the button is to be attached, and expandable to raise such material and thereby cause the loops to be opened above the button for receiving a thread bundle.

In U.S. Pat. No. 4,296,698 to R. D. Davidson et al. there is disclosed a button attaching hand tool comprising a box-like structure which includes a fixed and adjustable needle, and which includes a button storage compartment. A slidable shroud on the box-like structure for extricating a button and material from the needles is movable between a position in which an operator is shielded from injury by the needles and another position in which the needles are exposed for button sewing use.

In U.S. Pat. No. 4,316,562 to D. R. Davidson et al. there is disclosed a button attaching tool which includes a base, a pair of needles which have collapsible and expendable thread receiving eyes and which project from the base for use in penetrating a layer of material and the holes of a button to be attached to the material, and a member for stripping the material and button from the needles.

In U.S. Pat. No. 4,361,101 to W. H. W. Marsh et al. there is disclosed a button attaching device having a bifurcated needle holding member which can be utilized to adjust the spacing between a pair of needles, and with a needle cover which attaches the bifurcated member to protect one from injury by the needles and form a unit that can be conveniently carried on the person of a user.

In U.S. Pat. No. 5,518,162 to C. L. Deschenes et al., which is incorporated herein by reference, there is disclosed a fastener attaching tool particular suited for use in attaching buttons to clothing, etc. and which is constructed for use with a fastener clip which includes a pair of runner bars and one or more U-shaped fasteners having transverse bars at opposite ends, each transverse bar being connected on its side to a corresponding runner bar by a severable connector post. The tool includes a body having a front end. A pair of needles are pivotally mounted at the front end of the body, each needle having a longitudinal slotted bore adapted to receive one of the transverse bars and a knife edge formed on one side which is adapted to a connector post from its associated transverse bar as the transverse bar is pushed through the needle. The body is shaped to include a transverse feed slot down through which the fastener clip is manually inserted. The tool also includes an ejector mechanism which is slidable mounted back and forth within the body and is rearwardly biased by a spring. The ejector mechanism is moved manually forward from the rear of the tool and includes a pair of ejector rods which are in the needles. The body includes a pair of flexible fingers which cooperate with a pair of posts on the ejector mechanism to prevent automatic return of the ejector mechanism from its forwardmost position in the body to its rearwardmost position when forward pressure on the ejector mechanism is removed.

In U.S. patent application Ser. No. 08/305,486 filed on Sep. 13, 1994 in the name of Paul A. Davignon and assigned to the assignee of this application and which is incorporated herein by reference, there is disclosed a needle for use in the rodless dispensing of plastic fasteners of the type comprising a flexible filament and a cross-bar disposed at one end of the flexible filament. In one embodiment, the needle comprises a solid needle block assembly holder terminating at its front end in a top adapted to penetrate a desired article of commerce and a chamber adapted to receive a cross-bar of a plastic fastener. The chamber includes a front end, a rear end, an open top and an open bottom. The open top, which is spaced rearwardly a distance from the tip, is appropriately sized and shaped to permit the insertion and removal of a cross-bar into and from the chamber. The front end is downwardly angled towards the tip to releasably engage the top surface of the front end of the cross-bar, and the rear end has a pair of walls intersecting a V-shape to releasably engage both the top surface and the bottom surface of the rear end of the cross-bar in such a way as prevent the cross-bar from being pulled out of the chamber through the open top when low tension is applied to the flexible filament (i.e., prior to the complete insertion of the cross-bar through the article of commerce), but, yet, so as to cause the cross-bar to be pulled out of the chamber through the open top when high tension is applied to the flexible filament (i.e. following the complete insertion of the cross-bar through the article of commerce).

Accordingly, it is an object of this invention to provide a new and improved button attaching device.

It is a another object of this invention to provide a button attaching device which is hand operated and which can be carried on the person of a user.

It is a further object of this invention to provide a button attaching device which is simple in construction, contains a minimum number of parts, is inexpensive to manufacture and is easy to use.

SUMMARY OF THE INVENTION

A button attaching device constructed according to one embodiment of this invention includes a holder having a front end and a rear end, a needle block mounted on the holder, a pair of rodless fastener dispensing needles mounted on the needle block and projecting out from the front end of the holder, a fastener having a foot at each end of a filament, each foot being removably mounted on one of the rodless fastener dispensing needles, and a cover removably mounted on the holder, the cover including an anvil.

A button attaching device constructed according to another embodiment of this invention includes a holder having a front end and a rear end, a needle block mounted on each end of the holder, a pair of rodless fastener dispensing needles mounted on each needle block and projecting out from the holder, a pair of fasteners, each fastener fastener having a foot at each end of a filament, each fastener being removably mounted on one of the pairs of rodless fastener dispensing needles, a cover removably mounted on the front end of the holder and a cover removably mounted on the rear end of the holder, one of the covers including an anvil.

Various features and advantages of the present invention will be set forth in part in the description which follows, and in part will be obvious from the description or may be learned by practice of the invention. These embodiments will be described in sufficient detail to enable those skilled in the art to practice the invention, and it is to be understood that other embodiments may be utilized and that changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF THE DRAWINGS

Figure 1:
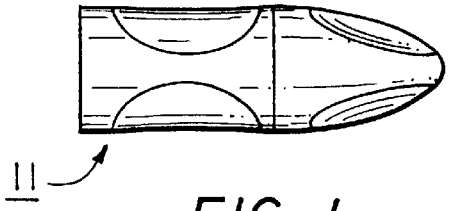
FIG. 1 is an elevation view of a button attaching device constructed according to this invention for attaching a button to a layer of material.
Figure 2A:
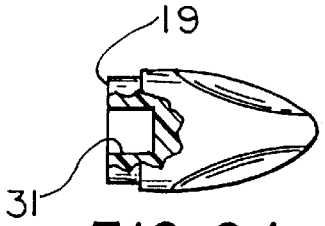
FIG. 2A is an elevation view partly broken away in section of the holder shown in FIG. 2.
Figure 2:
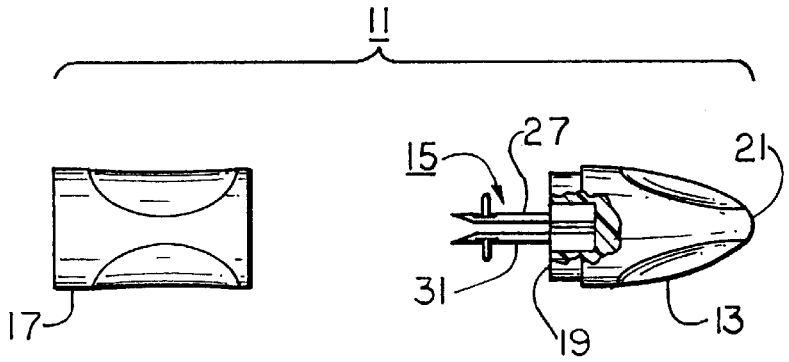
FIG. 2 is an elevation view of the button attaching device shown in FIG. 1, but with the cover separated from the holder and the holder being partially broken away in section.
Figure 3:
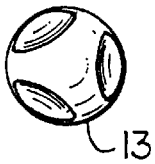
FIG. 3 is a right end view of the holder in the button attaching device shown in FIG. 1.
Figure 8:
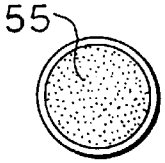
FIG. 8 is a left end view of the cover shown in FIG. 2.
Figure 7:
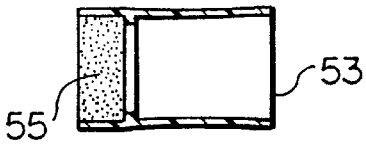
FIG. 7 is a longitudinal section view of the cover in the button attaching device shown in FIG. 1.
Figure 4:
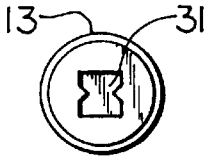
FIG. 4 is a left end view of the holder in the button attaching device shown in FIG. 1.
Figure 10:
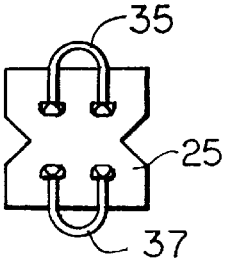
FIG. 10 is a left end view of the needle block shown in FIG. 5.
Figure 5:
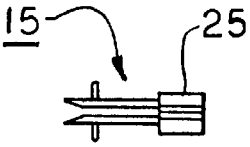
FIG. 5 is an elevation view of the needle block assembly shown in FIG. 2.
Figure 5A:
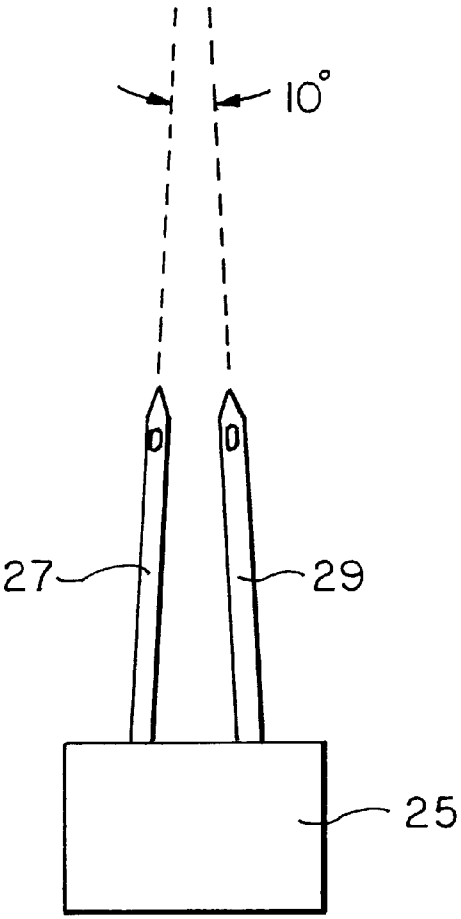
FIG. 5A is a top view of the needle block assembly shown in FIG. 2.

Referring now to the drawings and first to FIGS. 1 through 9, there is shown a button attaching device constructed according to this invention and identified generally by reference numeral 11.

Button attaching device 11 includes a holder 13, a needle block assembly 15 and a cover 17.

Holder 13 includes a front end 19 and a rear end 21. The outer surface 23 of holder 13 is shaped with concave portions so that it can be grasped easily by the fingers of a user. Holder 13 is made of a durable plastic.

Needle block assembly 15 includes a needle block 25, an upper pair of rodless fastener dispensing needles 27 and 29, a lower pair of rodless fastener dispensing needles 31 and 33 and two plastic fasteners 35 and 37. Needle block 25 is fixedly mounted by any suitable means in a recess 31 formed in the front end 19 of holder 13. Needles 27 through 33 are identical in construction and are fixedly mounted by any suitable means on block 25. Needle block 25 is made of elastomeric material so that needles 27, 29, 31 and 33 can accommodate variations in button hole spacings. Needles 27 and 29 are biased in towards each other to form an angle of about 10 degrees and needles 31 and 33 are angled in towards each other in the same way so that a four holed button can be mounted thereon, if desired, and will not fall off. Needles 27 through 33 may be, for example, needles such as shown and described in U.S. patent application Ser. No. 08/305,486. Fastener 35 includes a pair of feet (bars) 39 and 41 connected by a filament 43. Fastener 37 is identical to fastener 35 and includes a pair of feet 45 and 47 connected by a filament 49. Fasteners 35 and 37 may be, for example, fasteners such as shown in U.S. Pat. No. 5,518,162. Feet 39 and 41 of fastener 35 are removably seated in cavities 50-1 and 50-2 in needles 27 and 29. Fastener 37 is mounted on needles 31 and 33 in a similar manner.

Cover 17 is slidably and removably mounted on needle block assembly holder 13. Cover 17 comprises a tubular member 51 open at each end. An anvil 55 is fixedly mounted by any suitable means at one end 56 of member 51. Anvil 55 is made of a material which can be penetrated by needles 27 through 33. An example of such a material is soft plastic foam. A wall 57 formed in body 51 provides support for anvil 55.

Figure 9A:
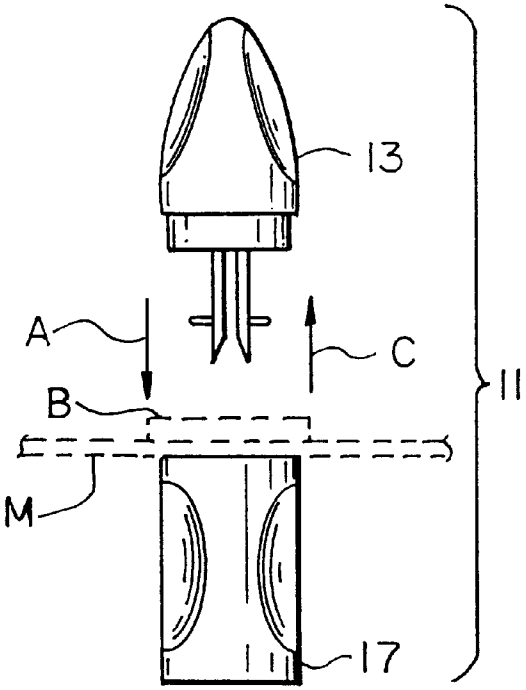
FIG. 9A is an elevation view showing how the parts of the button attaching device are positioned for use.
Figure 9:
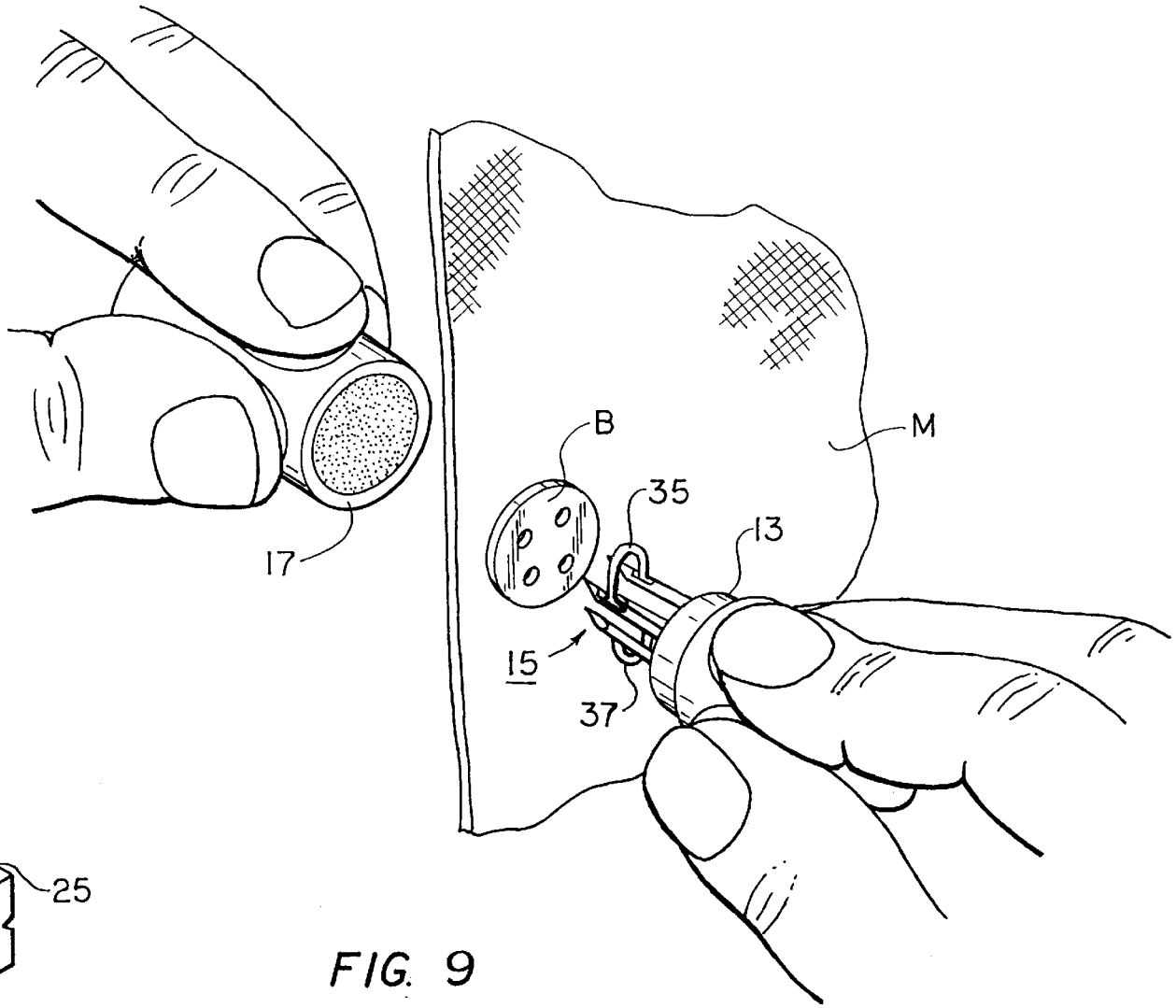
FIG. 9 is a perspective view useful in understanding how the button attaching device in FIG. 1 is used.
Figure 6:
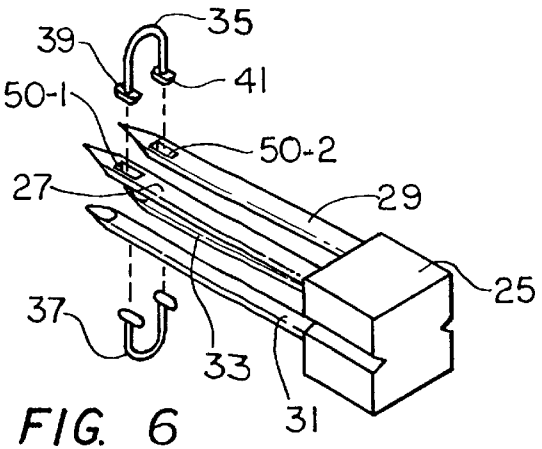
FIG. 6 is an exploded view of the needle block assembly shown in FIG. 2.
Figure 11:
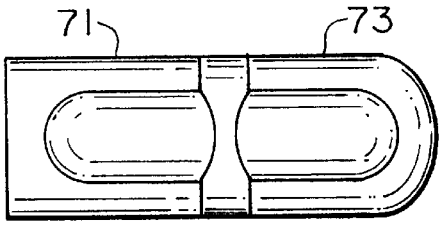
FIG. 11 is an elevation view of another embodiment of a button attaching device according to this invention.
Figure 12:
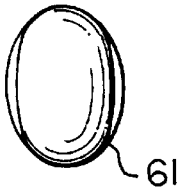
FIG. 12 is a right end view of the button attaching device shown in FIG. 10.
Figure 13:
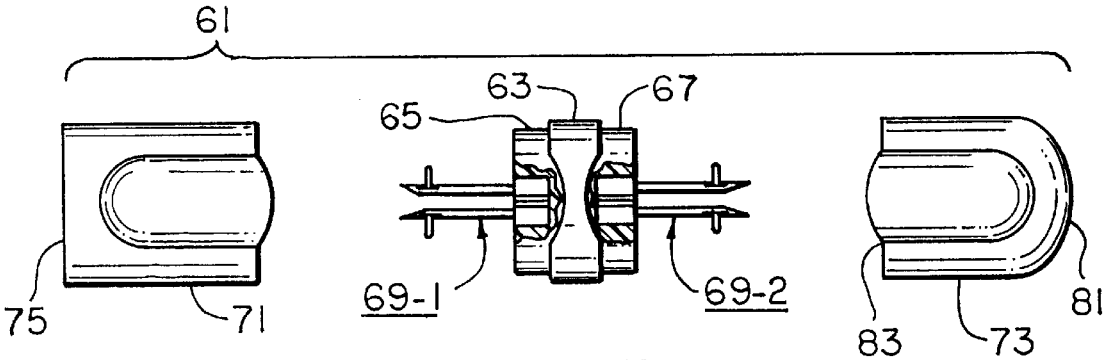
FIG. 13 is an elevation view of the button attaching device shown in FIG. 11; but with the two covers separated from the holder and the holder being partly broken away in section.
Figures 14, 15:
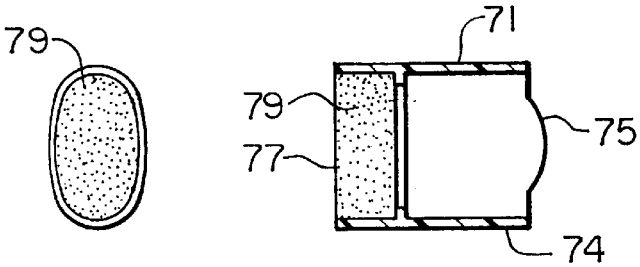
FIG. 14 is a longitudinal section view of the left end cover shown in FIG. 13.
FIG. 15 is a left end view of the cover shown in FIG. 13.
Figure 16:
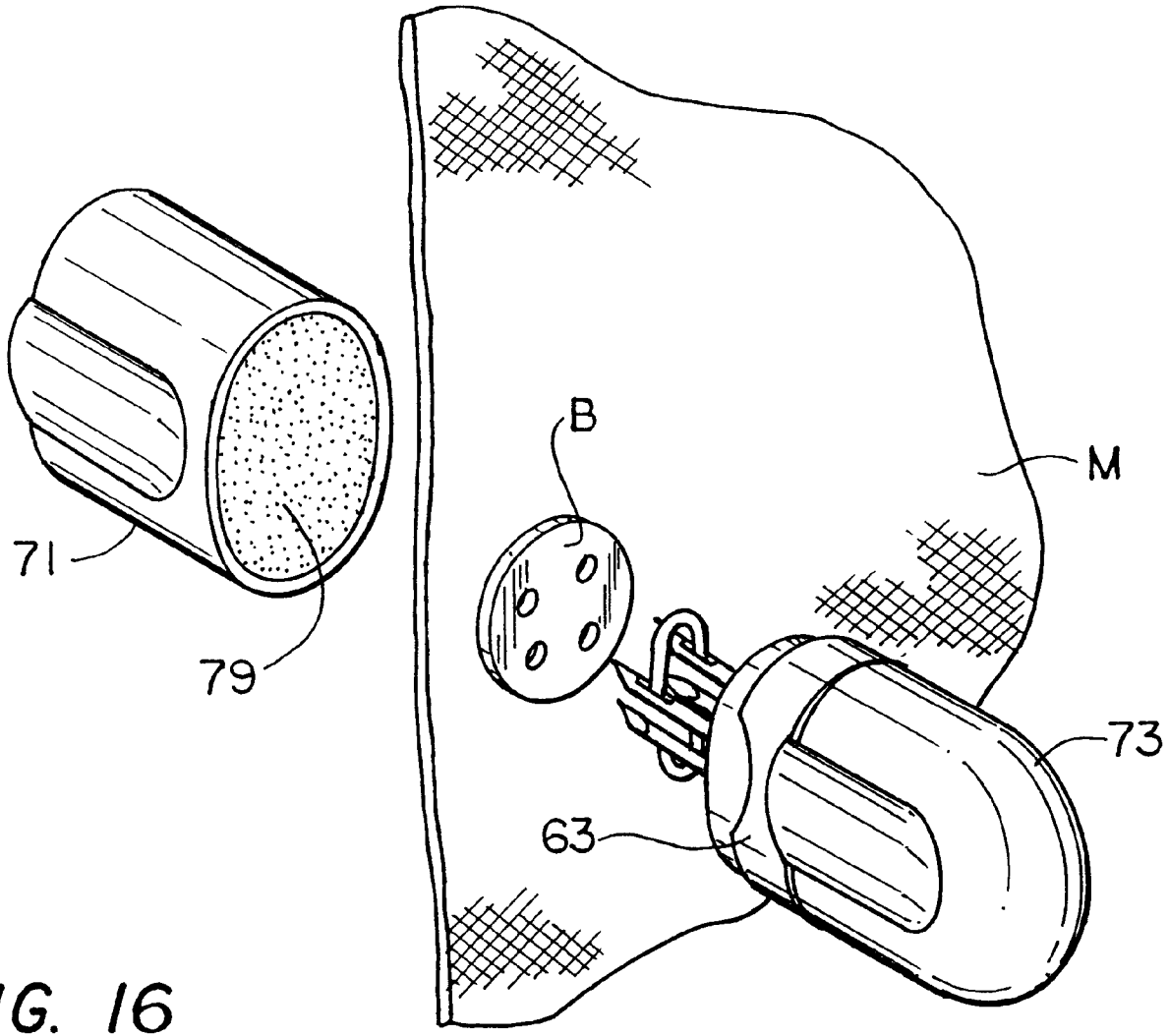
FIG. 16 is a perspective view useful in understanding how the button attaching device in FIG. 11 is used.

To use device 11 to attach a button B to a layer of material M, a person removes cover 17 from holder 13 and then places layer of material M on end 56 of cover 17 and places button B over layer of material M, as shown in FIG. 9A. The user then pushes holder 13 toward cover 17 as shown by arrow A in FIG. 9 so that the tips of needles 27 through 33 and feet 39, 41, 45 and 47 pass through holes 57, 59, 61 and 63, respectively in button B and pass through layer of material M, the tips of needles 27 through 33 striking anvil 55. The tension on filaments 35 and 37 due to the length of filaments 35 and 37 and the thickness of button B and layer of material M causes feet 39, 41, 45 and 47 to pop out from their respective cavities in the needles. The user then pulls holder 13 back in the direction shown by arrow C in FIG. 9A, leaving button B secured to layer of material M by fasteners 35 and 37.

In FIGS. 11–15 there is shown another embodiment of a button attaching device constructed according to this invention and identified by reference numeral 61.

Device 61 includes a holder 63 having a front end 65 and a rear end 67, a pair of needle block assemblies 69-1 and 69-2, identical to needle block assembly 15, one fixedly mounted on each end of holder 63, a cover 71 removably mounted on front end 65 of holder 63 and a cover 73 removably mounted on rear end 67 of cover 73. Cover 71 comprises a tubular member 74 open at each end 75 and 77 and a body 79 of plastic foam material which serves as an anvil mounted on end 75. Cover 73 is a hollow member closed at one end 81 and open at the other end 83.

To use device 61, a person removes cover 71 from holder 63 and then uses device 61 to attach button B to layer of material in the same way as device 11 is used. The user then removes cover 73, mounts it on front end 65 of holder 63 and uses needle block assembly 69-2 to attach another button to a layer of material. Thus, device 61 can be used to attach two four hole buttons rather than one button as with device 11.

Instead of having four needles, the needle block assemblies could, if desired, have only two needles (and one fastener). Also, the needle block assemblies could be removably rather than fixedly mounted in the holders. In addition, the buttons could, if desired, be mounted on the needle rather than placed on the material as described above. Furthermore, instead of being a separate piece, the anvil could be a screen integrally formed in the cover.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A button attaching device for use in attaching a button to a layer of material, the button having a pair of holes, the button attaching device comprising:

a. a holder having a front end and a rear end, b. a needle block mounted in the holder, c. a pair of rodless fastener dispensing needles mounted on the needle block, d. a fastener for securing the button to the layer of material, the fastener having a foot at each end of a filament, each foot being removably mounted on one of the rodless fastener dispensing needles, and e. a cover removably mounted on the holder, the cover including an anvil.

2. A button attaching device comprising:

a. a holder having a front end and a rear end, b. a needle block mounted on each end of the holder, c. a pair of rodless fastener dispensing needles mounted on each needle block, d. pair of fasteners, each having a foot at each end of an elongated filament, each fastener being removably mounted one of the pair of rodless fastener dispensing needles, e. a cover removably mounted on the front end of the holder, and f. a cover removably mounted on the rear end of the holder, g. one of said covers including an anvil.

3. A button attaching device comprising:

a. a holder having a front end and a rear end, b. four rodless fastener dispensing needles projecting out from the front end of the holder, c. two fasteners, each having a foot at each end of a filament, each foot being removably mounted on one of the rodless fastener dispensing needles, and d. a cover removably mounted on the front end of the needle block assembly holder.

4. A button attaching device comprising:

a. a holder having a front end and a rear end, b. two pairs of rodless fastener dispensing needles projecting out from the front end of the holder, c. two fasteners each having a foot at each end of an elongated filament, each foot being removably mounted one of the pair of rodless fastener dispensing needles extending out from the front end of the holder, d. two pairs of rodless fastener dispensing needles projecting out from the rear end of the holder, e. two fasteners, each having a foot at each end of an elongated filament, each foot being removably mounted on one of the pair of rodless fastener dispensing needles extending out from the rear end of the holder, f. a cover removably mounted on the front end of the holder, and g. a cover removably mounted on the front end of the rear end of the holder.

5. A button attaching device comprising:

a. an needle block assembly holder having a front end and a rear end, b. a needle block assembly mounted on the front end of the needle block assembly holder, the needle block assembly including:

i. a block of material, ii. a pair of rodless fastener dispensing needles, iii. a fastener having a foot at each end of a filament, each foot being removably mounted on one of the pair of rodless fastener dispensing needles, and c. a cover removably mounted on the front end of the needle block assembly holder, the cover including an anvil.

6. The button attaching device of claim 1 wherein said anvil is a body of foam plastic.

* * * * *